US008302659B2

(12) United States Patent
Smetan et al.

(10) Patent No.: US 8,302,659 B2
(45) Date of Patent: Nov. 6, 2012

(54) METHOD AND DEVICE FOR CASTING A CAST PART FROM A METAL MELT

(75) Inventors: Herbert Smetan, Rehlingen-Siersburg (DE); Klaus Lellig, Wallerfangen (DE)

(73) Assignee: Nemak Dillingen GmbH, Dillingen (DE)

( * ) Notice: Subject to any disclaimer, the term of this patent is extended or adjusted under 35 U.S.C. 154(b) by 0 days.

(21) Appl. No.: 13/129,707

(22) PCT Filed: Nov. 23, 2009

(86) PCT No.: PCT/EP2009/065627

§ 371 (c)(1), (2), (4) Date: Oct. 5, 2011

(87) PCT Pub. No.: WO2010/058003

PCT Pub. Date: May 27, 2010

(65) Prior Publication Data

US 2012/0012272 A1 Jan. 19, 2012

(30) Foreign Application Priority Data

Nov. 24, 2008 (DE) ..... 10 2008 058 742

(51) Int. Cl.
*B22D 23/00* (2006.01)
*B22D 27/08* (2006.01)
*B22D 35/04* (2006.01)

(52) U.S. Cl. ..... 164/136; 164/336

(58) Field of Classification Search ..... 164/136, 164/336

See application file for complete search history.

(56) References Cited

U.S. PATENT DOCUMENTS

| | | | | |
|---|---|---|---|---|
| 5,492,165 | A | 2/1996 | Erana | |
| 5,704,413 | A | 1/1998 | Takasaki et al. | |
| 6,540,007 | B2 * | 4/2003 | Meyer | 164/119 |
| 7,296,612 | B2 | 11/2007 | Bend | |
| 7,926,544 | B2 | 4/2011 | Greif et al. | |
| 2002/0000304 | A1 | 1/2002 | Kahn et al. | |
| 2007/0062666 | A1 | 3/2007 | Bend | |
| 2008/0190581 | A1 * | 8/2008 | Smetan | 164/114 |

FOREIGN PATENT DOCUMENTS

| | | | |
|---|---|---|---|
| DE | 10019309 | A1 | 10/2001 |
| DE | 102005060826 | A1 | 6/2007 |
| EP | 0599768 | A1 | 6/1994 |
| JP | 11291022 | A | 10/1999 |
| JP | 2008100276 | A * | 5/2008 |

* cited by examiner

*Primary Examiner* — Jessica L Ward
*Assistant Examiner* — Kevin E Yoon
(74) *Attorney, Agent, or Firm* — The Webb Law Firm

(57) ABSTRACT

A method and a device for casting a cast part from a metal melt. A casting mould in a pivoted mounting comprising a mould cavity shaping the cast part, a feed system and a pour channel, is rotated into a fill position and filled with metal melt. Due to the effect of gravity, the melt flows through the pour channel, wherein the main flow direction of the melt makes an angle relative to the acting direction of gravity. Filling is continued until the casting mould, including the pour channel, is completely filled. Then, the casting mould is sealed with a stopper and rotated into a solidification position, in which the melt in the feed system is pushed against the melt in the mould cavity. The casting mould is held in the solidification position until the metal melt has reached a solidification state in which the cast part can be de-moulded.

11 Claims, 5 Drawing Sheets

METHOD AND DEVICE FOR CASTING A CAST PART FROM A METAL MELT

BACKGROUND OF THE INVENTION

1. Field of the Invention

The invention relates to a method for casting a cast part from a metal melt and a suitable device for performing such a method. The metal melt processed according to the invention is in particular a light metal melt, preferably an aluminium- or an aluminium alloy-based melt.

2. Description of Related Art

The properties of a cast part are heavily influenced by the course of the solidification of the melt in the casting mould and the feeding necessary to compensate for shrinkage. Thus a particularly even distribution of properties results if the filling of the mould with melt is carried out in a continuous process avoiding high melt flows in the casting mould, and the solidification then starts with an even distribution on the opposite side of the casting mould from the feeder.

Particularly high-quality cast products can be produced by so-called rotation moulding. One embodiment of this moulding method that has been tried and tested in practice for the production of high-quality cast parts was proposed in DE 100 19 309 A1. According to this a melt container containing metal melt with its opening directed upwards is docked with a filling opening pointing downwards of a casting mould. Then the casting mould along with the melt container in a fixed connection with it is rotated through approximately 180°. In the course of the rotation the melt passes from the melt container to the casting mould. Once the final rotational position has been reached, the melt container is removed from the casting mould. The hot residual melt which is now located at the top in the feeder area can then remain effective through gravity and efficiently balance out the volume loss associated with the solidification of the melt.

Through the rotation of the casting mould with the melt container a complete filling of the casting mould with metal melt is achieved. Because in the course of the casting mould rotation the metal melt filling the casting mould is evenly subjected to gravity, the melt reliably reaches all areas of the mould cavity of the casting mould which reproduces the cast part to be cast. In addition, the structure of the cast part is optimised as a result of the directed solidification which is brought about by the alignment of the casting mould associated with the rotation.

Problems arise with the rotation moulding performed in the above way, however, when for cylindrical internal geometries particularly even solidification morphologies are required. As a result of the casting mould initially being filled against gravity and then rotated for cooling, a calmer filling of the mould and associated improved solidification can indeed be achieved. However, even before rotation, casting defects can arise which mostly take the form of bubbles or cold runs. These casting defects are due to the fact that the melt even before rotation of the casting mould cools to such an extent in the casting mould that uncontrolled solidification fronts (or 'cold runs') form or the melt contracts in the casting mould with the inclusion of bubbles.

SUMMARY OF THE INVENTION

Against this background the object of the invention was to provide a method and a device with which high-quality, complex shaped cast parts can be produced economically and with high operational reliability.

According to the invention, for casting a cast part from a metal melt a casting mould mounted in a pivoted mounting is firstly provided (step a). This casting mould comprises a mould cavity shaping the cast part, a feed system for feeding the mould cavity with metal melt and a pour channel, via which the feed system can be filled with metal melt. Here the feed system is arranged in relation to the mould cavity of the casting mould so that when the casting mould is rotated into a fill position the filling of the mould cavity with the metal melt takes places via the feed system against the acting direction of gravity. At the same time the filling opening, provided for the filling of the metal melt, of the pour channel is arranged on a lateral side of the casting mould remotely from its mouth into the feed system so that the filling opening of the pour channel is arranged in the respective fill position of the casting mould above the mouth into the feed system.

Prior to filling, the casting mould provided in this way is aligned in a fill position in which metal melt filled in the pour channel as a consequence of the effect of gravity flows through the pour channel, wherein the main flow direction of the metal melt makes an angle relative to the acting direction of gravity (step b). "Main flow direction" of the metal melt in this connection means the flow direction in which the melt independently of the actual course of the pour channel would have to flow in order to take a direct path from the filling opening to the mouth of the filling channel into the feed system. Here it is self-evident that the alignment of the casting mould in the fill position specified according to the invention in each case can be carried out in a separate step, but that it is just as possible to align the casting mould in the course of its providing so that it meets the requirements of the procedure according to the invention.

The casting mould aligned in the fill position is then filled with the metal melt, until the casting mould, including the pour channel, is completely filled with metal melt (step c).

Once the casting mould is sufficiently full, it is sealed with a stopper placed in the filling opening of the pour channel (step d). Then the casting mould is rotated into a solidification position, in which as a result of the effect of gravity the melt present in the feed system is pushed against the melt present in the mould cavity (step e). The casting mould is held in this position until the metal melt present in the casting mould has reached a certain solidification state (step f). Then the cast part is de-moulded (step g).

As a result of the manner according to the invention of the filling, the subsequent sealing and maintenance of the seal of the casting mould and the rotation of the casting mould so that the metal melt contained in the feed system of the casting mould pushes against the melt forming the cast part, casting defects are avoided. Apart from the particularly sedate filling process, a further contribution is made to this in particular by the fact that the metal melt contained in the casting mould from the end of filling and during the entire solidification process remains under metallostatic pressure. Thus, as a result of the column of melt remaining in the pour channel after sealing, contraction of the melt in the mould cavity shaping the cast part is counteracted. At the same time the tight sealing of the casting mould, allows commencement of the rotation of the casting mould immediately after completion of the filling process without the filling device itself or other expensive components also having to be moved with it in order to do so.

As a result of the alignment according to the invention (steps a)-c)) of the casting mould and the associated alignment at an angle relative to the acting direction of gravity of its main flow direction, the metal melt due to the correspondingly lower gravitational force acting on the flow speed flows significantly more slowly through the pour channel than would be the case if the main flow direction of the melt and the acting direction of gravity were to coincide. With the procedure according to the invention the casting mould fills up with metal melt with corresponding calmness from the start of the filling process.

The problematical turbulence and flow irregularities of the melt immediately at the start of filling in particular in the known rotation moulding method are significantly minimised by the procedure according to the invention. Just this simple measure contributes to a significant increase in casting quality.

Because the casting mould after reaching a certain fill level of the metal melt is rotated, while continuing to be filled, in such a way that the main flow direction of the metal melt flowing through the pour channel increasingly approximates to the acting direction of gravity, the effect of gravity in the further course of the filling process can be fully utilised. Here the quantity of melt already present at this point in time in the feed system or in the pour channel, brakes the melt flowing into the casting mould so that even with a pour channel that is increasingly slewed in the direction of the force of gravity a calm, even filling of the casting mould is ensured.

Additionally, due to the rotation of the casting mould performed during filling in the direction of the effect of gravity, optimum effectiveness of the metallostatic pressure at the point in time when the casting mould is sealed is ensured. Therefore a practice-oriented design of the invention provides that the rotation performed during the filling process is ended when the main flow direction of the metal melt flowing through the filling channel coincides with the acting direction of gravity.

The advantages that are achieved by the main flow direction being aligned at an angle at the start of filling on the one hand and the subsequent rotation performed during the filling process on the other hand, can be utilised particularly effectively if the rotation of the casting mould is commenced at the earliest when the mouth of the pour channel into the feed system is below the level of the metal melt filled in the casting mould. In this way with simultaneous optimum utilisation of the advantages of an alignment of the main flow direction that extensively coincides with the acting direction of gravity the danger of excessive turbulence and the formation of gas bubbles in the cast part is reduced to a minimum.

The result is that with the method according to the invention in a particularly economical manner a significantly less scrap rate for cast parts can be achieved than with the known casting method whilst still meeting the strictest quality requirements for these.

In accordance with the process described above for the method according to the invention, a device for casting cast parts from a metal melt has a retainer for retaining a casting mould, a rotational drive for rotating the casting mould around an axis of rotation and a filling device for filling metal melt into a filling opening of the casting mould, wherein with such a device according to the invention a tracking device is provided which tracks the filling device relative to a change in position of the filling opening of the casting mould during filling of the metal melt caused by a rotational movement of the casting mould.

For the filling of the casting mould a conventional pouring spoon can be used, which by means of a suitable tracking device is brought into a corresponding fill position of the filling opening of the casting mould and if necessary tracks the change in position of the filling opening associated with a rotation of the casting mould.

The method according to the invention and the device according to the invention are particularly suited to the manufacture of engine blocks for combustion engines. With these comparatively complex-shaped cast parts it may be necessary for certain sections of the casting mould to undergo prior thermal treatment so that the melt filled in the casting mould, upon contact with the section concerned, demonstrates the desired wetting or solidification behaviour. A typical example of such casting mould sections are so-called "cylinder liners" or "cylinder sleeves", which are cast into a light metal engine block, in order to guarantee sufficient wear resistance in the area of the cylinder openings of the engine block. These liners or sleeves, which are as a rule made from a steel material, have a markedly higher thermal conductivity than the sand of which the casting cores or casting parts of the casting mould typically consist. Because the parts to be cast into the cast part are preheated, an improved wetting with the cast metal is achieved and the danger of occurrence of thermal stresses and undesired structural formations is countered.

The location of the axis of rotation around which the casting mould is rotated when performing the method according to the invention is insignificant, provided that it is ensured that through the rotation a positioning of the casting mould and its pour channel results in which the main flow direction of the metal melt filled in the casting mould is aligned in the manner according to the invention. A particularly simple and practice-oriented design of a device according to the invention used for performing the method according to the invention results, however, if the axis of rotation of the casting mould is aligned horizontally.

Similarly, a particularly simple design of a device formed according to the invention can be achieved if the pour channel of the casting mould runs linearly.

An additional contribution can be made to a simple and thus at the same time cost-effective device if the filling opening of the pour channel is arranged on an underside of the casting mould which in the solidification state is arranged opposite a top side of the casting mould delimiting the feed system.

In order to achieve the most extensive possible free, versatile usability of a device according to the invention, its rotational drive should be able to rotate the casting mould through an angle of more than 180°.

BRIEF DESCRIPTION OF THE DRAWINGS

Each of FIGS. 1 to 10 shows schematically one of ten operating positions of a device 1 for casting a cast part G shown in a cross-sectional view normal to its longitudinal axis.

DETAILED DESCRIPTION OF THE INVENTION

Figure 1:
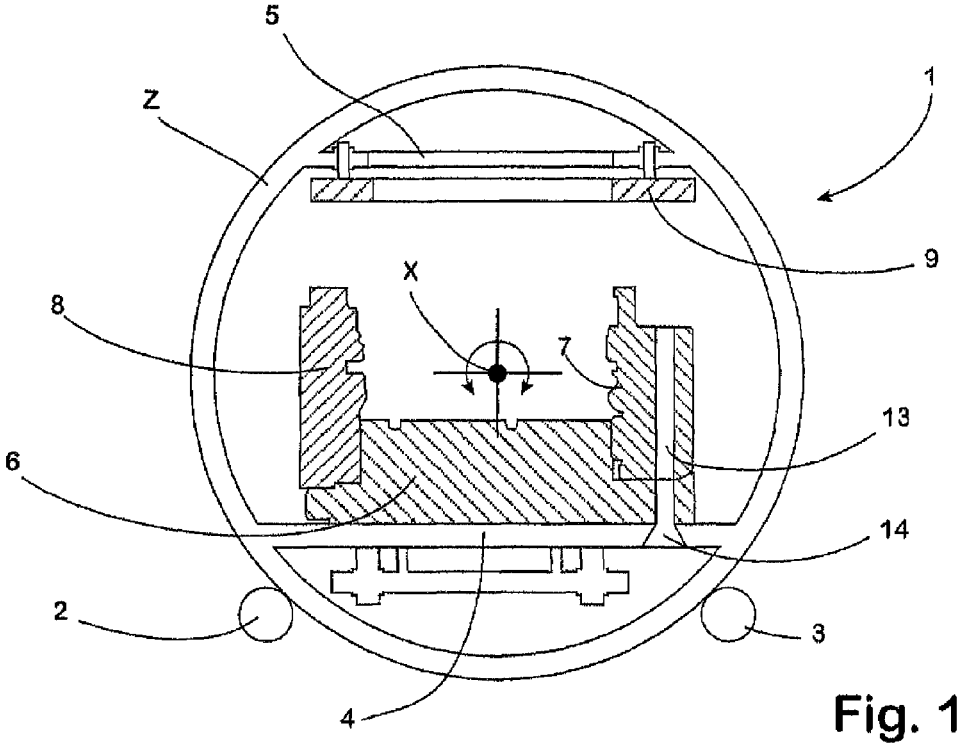

The cast part G here is an engine block for a four-cylinder combustion engine. The casting metal used in the exemplary embodiment described here is aluminium casting melt.

The device 1 comprises a circular cylindrical casting cell Z shown in cross-section in the Figures, mounted on two rollers 2, 3 and rotationally driven by a drive that is not shown, in which a flat mounting floor 4 and a guide plate 5 aligned parallel with and distanced from the mounting floor 4 are secured.

On the upper surface of the mounting floor 4 allocated to the guide plate 5 there is a base plate 6. This is part of the casting mould F made from various casting mould parts and casting mould cores. The base plate 5 has lateral seats, in each of which sits a front slide 7, 8 with a correspondingly formed shoulder so that the front slides 7, 8 sit with a positive fit in the base plate 6. Of the front slides typically present on the casting mould G, for the purposes of clarity, only the slides 7, 8 allocated to the periphery of the casting cell Z, on the opposite sides of the base plate 5, are shown.

In the guide plate 5 a pressing plate 9 extending parallel to the underside of the guide plate 5 turned towards the mounting floor 4 is supported in such a way that it can be adjusted in the direction of the mounting floor 4, in order after the assembly work to retain the casting mould F, and enable it to be moved away from the mounting floor, so that upon completion of the casting process the casting mould F can be demounted and the finished cast part G de-moulded.

Between the front slides 7, 8 in a known fashion the cylindrical sleeves B encompassing in the radial direction the cylindrical cavities of the engine block cast part G to be cast and the cores K are then inserted, which within the cast part G define those channels and cavities which are not to be filled with casting metal M.

On the upper surface of the casting mould F allocated to the pressing plate 9 a bottom core O is positioned which holds the front slides 7, 8 with a positive fit in their upper section allocated to the guide plate 5 and with the base plate 6, the front slides 7, 8, the cores K, the cylindrical sleeves B and the bottom core O defines the mould cavity H of the casting mould F.

On the bottom core O finally a further feed core S is positioned, which comprises a feed system with a circulating large-volume feed channel 10, which when the feed core S is fully assembled runs above the front slides 7, 8. Here the feed core S defines an opening 11, via which the cylindrical openings in each case encompassed by the cylindrical sleeves B are accessible. The feed channel 10 is connected via various ingates 12 with the mould cavity H of the casting mould F.

In the casting mould a linearly formed pour channel 13, also referred to in technical parlance as a "sprue" is formed, which extends through the front slide 7, the lateral section of the base plate 4 allocated to it and arranged between the front slide 7 and the mounting floor 4 and the feed core 11 and is aligned normally to the mounting floor 4 and leads from a funnel-shaped filling opening 14 formed in the mounting floor 4 in a direct path and in a straight line to the feed channel 10 of the feed core S, in which it opens into a mouth 15.

Once the feed core S has been fitted, the pressing plate 9 is lowered onto the casting mould F prepared in this way in order to ensure the assembly position of the positively fitting interlocking parts and cores of the casting mould F.

Now the casting cell. Z with the casting mould F retained within it is rotated through 180° around an axis of rotation X aligned horizontally and coinciding with the longitudinal axis of the casting mould F, until the base plate 5 is positioned at the top seen in the acting direction WK of gravity and the feed core S at the bottom. Accordingly the filling opening 14 of the pour channel 13 is positioned on the mounting floor 4 now at the top.

Figure 3:
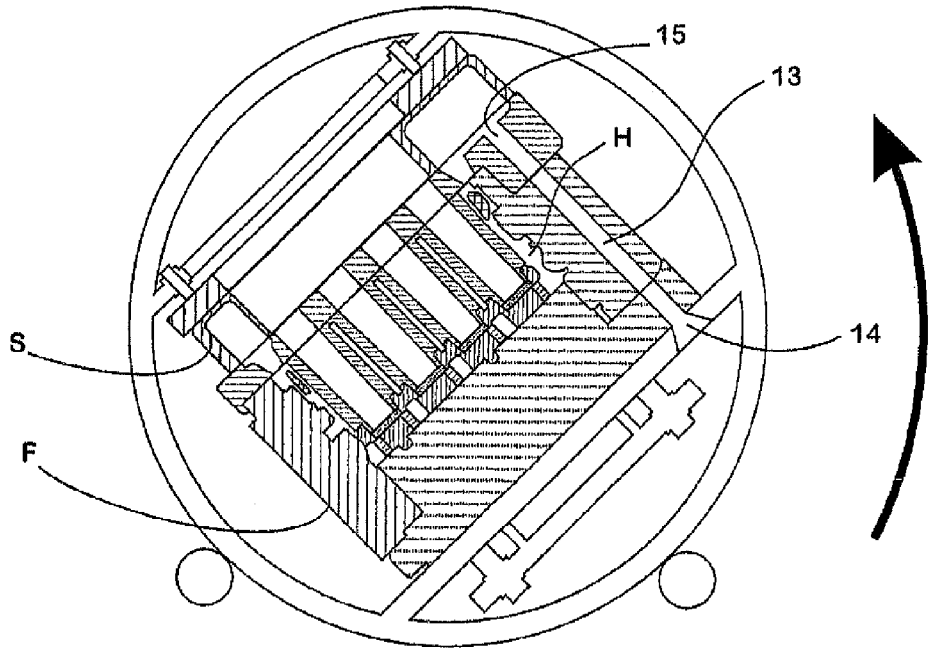
Figure 4:
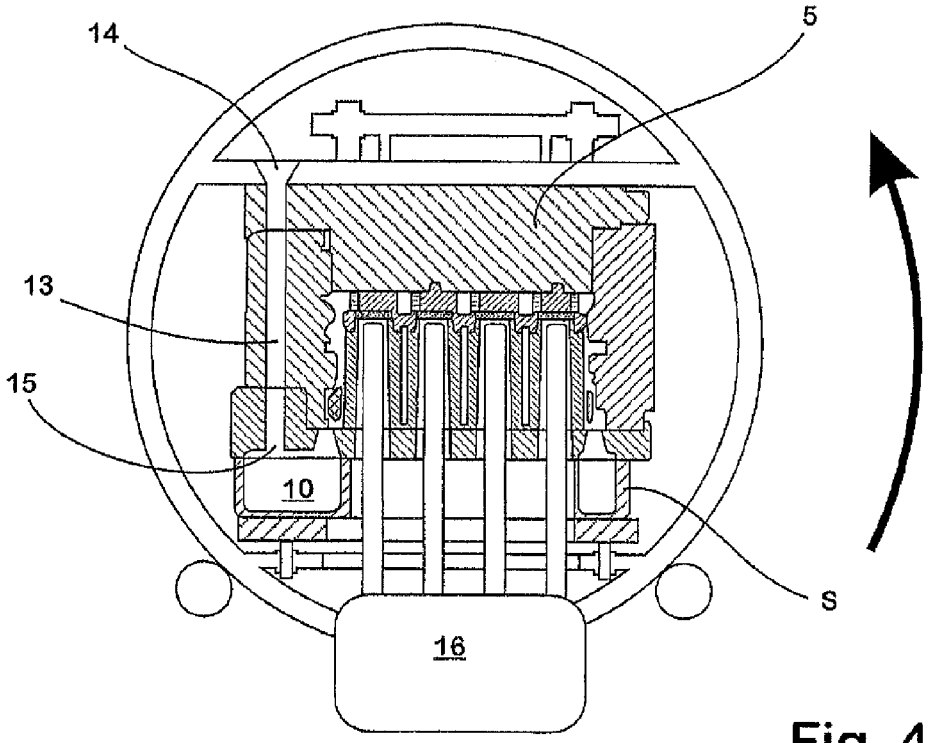

Once this position has been reached, a heating bar of a heating device 16 for inductive heating is inserted into each of the cylindrical sleeves B in order to heat these to a specified temperature (FIGS. 3, 4).

Following the heating of the cylindrical sleeves B ,he casting cell Z is again rotated clockwise through an angle of approximately 45° around the axis of rotation X. In this "fill position" the pour channel 14 running in a straight line is accordingly also at an angle of approximately 45° to the acting direction WK.

Then by means of a casting device 17 in the form of a pouring spoon the metal melt M to be cast is poured into the filling opening 14 of the pour channel 13. Because of the angle of the casting mould F the melt M runs comparatively slowly through the pour channel 13 and enters with correspondingly low kinetic energy the feed channel 10 of the feed core S. Its main flow direction SR here has the same alignment as the pour channel 13, so that the main flow direction SR of the melt M flowing through the pour channel 13 is aligned at an angle of approximately 45° to the acting direction WK of gravity.

Figure 5:
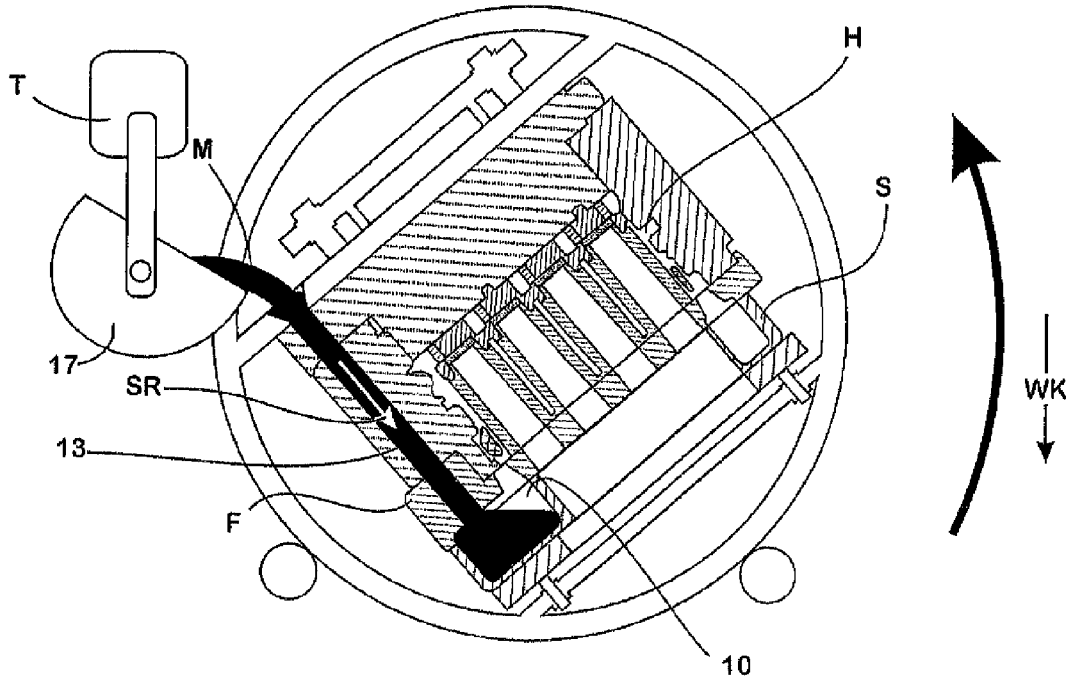
Figure 6:
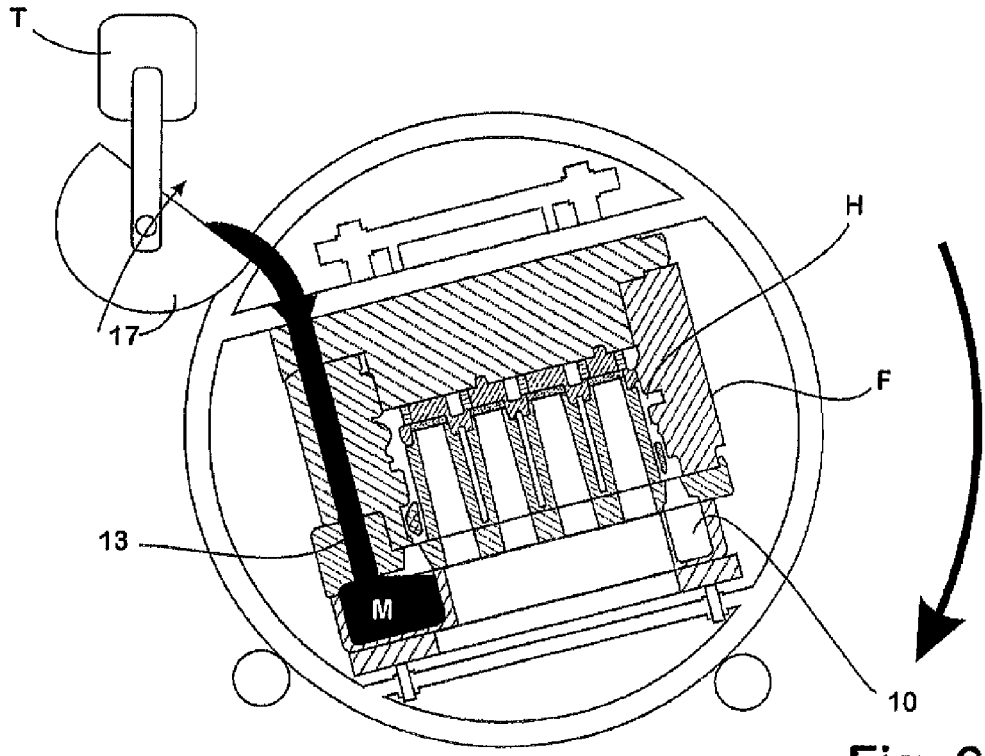

The filling of the inclined casting mould F with the metal melt M is continued until the mouth 15 of the pour channel 13 is below the level of the metal melt M collecting in the feed channel 11 (FIG. 5).

Once this state has been reached, the casting cell Z is slowly rotated in the clockwise direction until the pour channel 13 from its filling opening 14 to the mouth 15 in the feed channel points vertically downwards.

Figure 7:
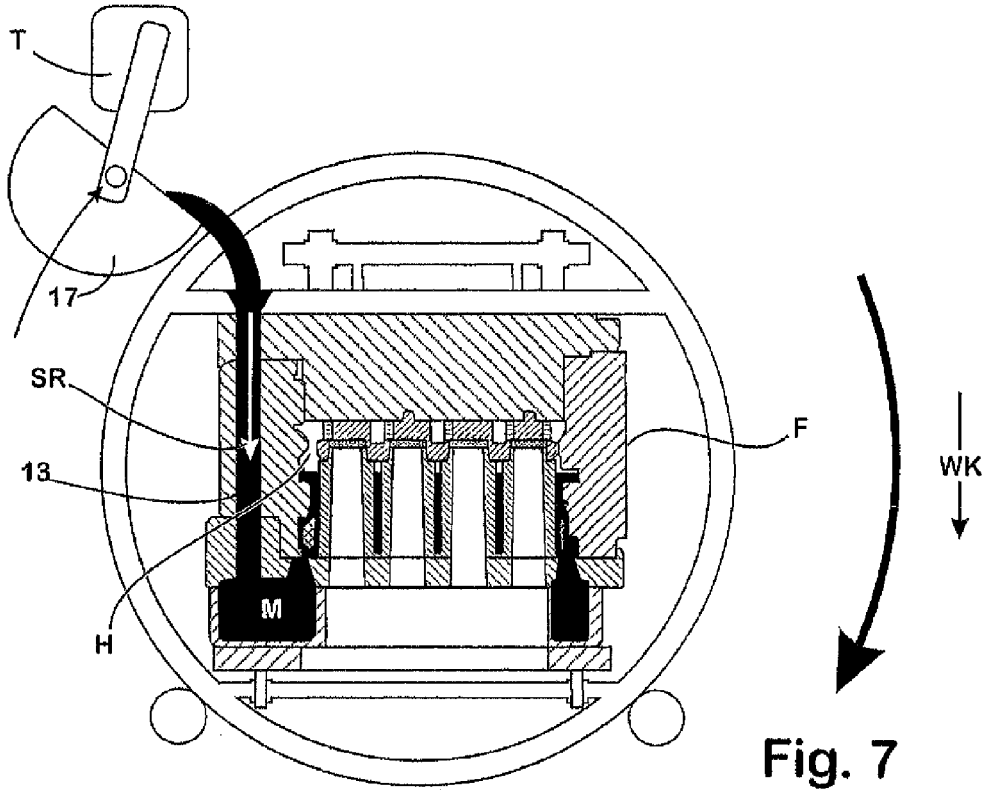

Filling the casting mould F with metal melt M is performed continuously during rotation. To this end the casting device 17 is tracked by means of a tracking device T, which may for example be an actuating drive or a crane, on which the casting device is in each case suspended, which tracks the change in position of the filling opening 14 associated with the rotation of the casting cell Z. Once the end position of this rotation has been reached the main flow direction SR of the melt M coincides with the acting direction WK of gravity, so that the filling of the remaining sections of the mould cavity of the casting mould F takes place with optimum utilisation of the force of gravity (FIGS. 7, 8).

Figure 8:
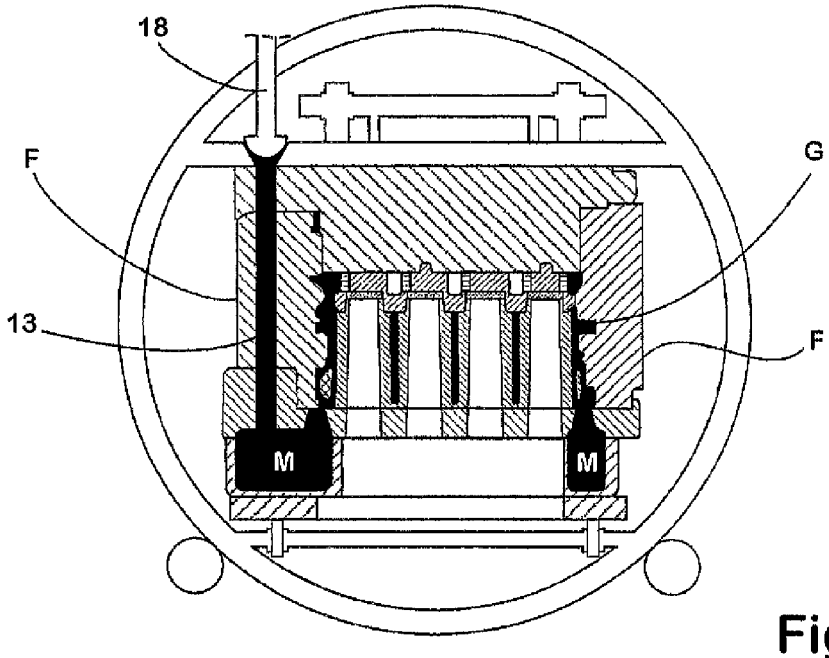
Figure 9:
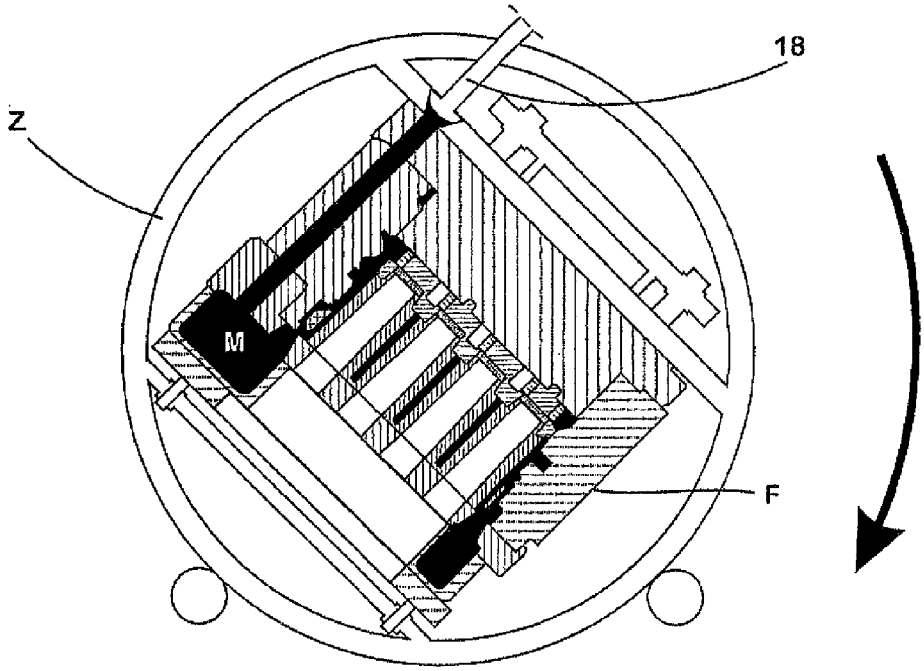
Figure 10:
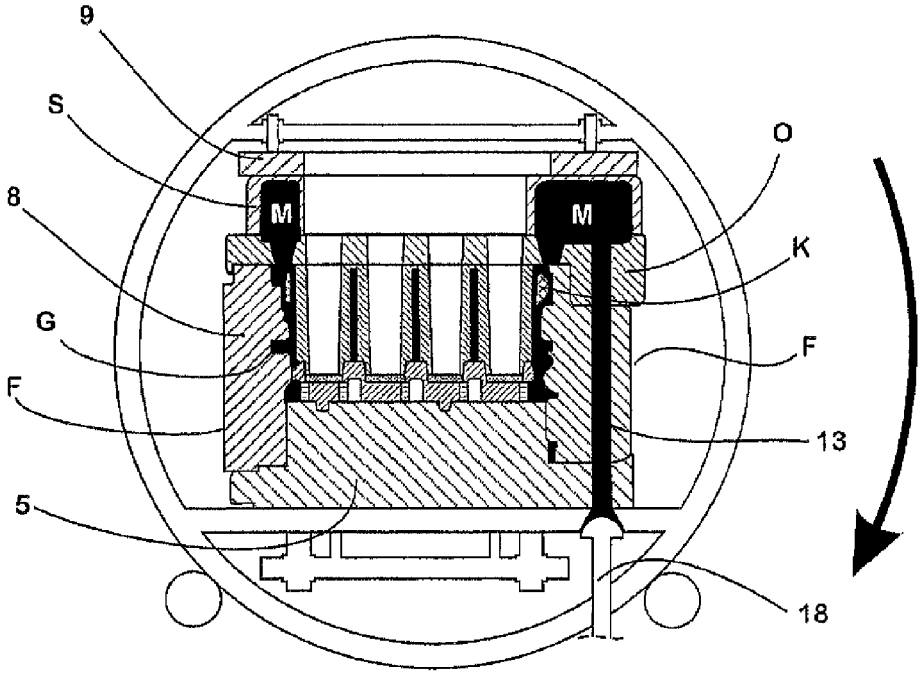

As soon as a sufficient melt quantity has been filled in the casting mould F, a stopper 18 is placed in the filling opening 14 providing a tight seal to this (FIG. 8).

Figure 2:
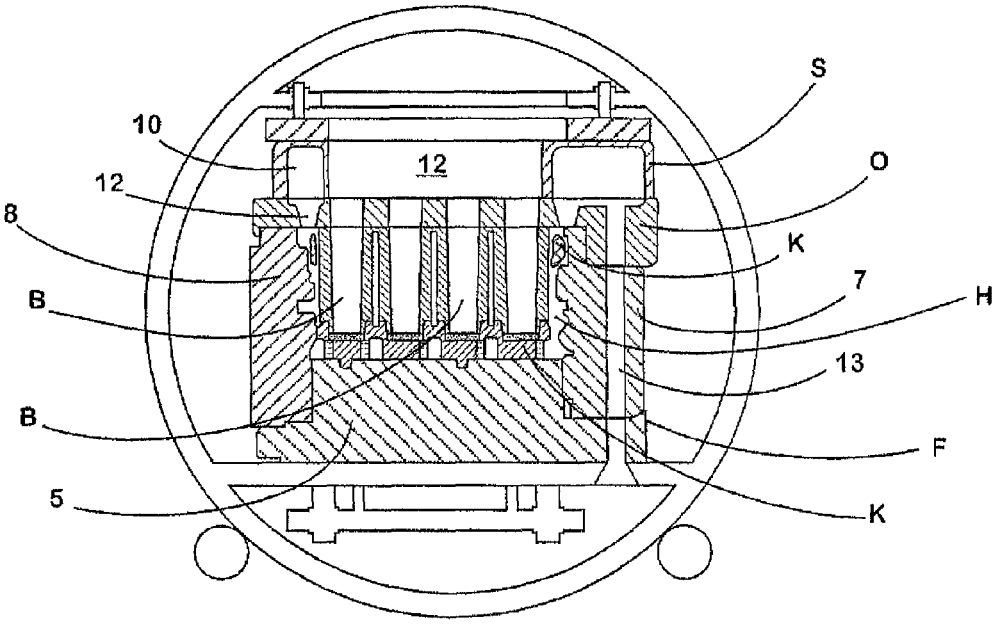

Then the casting cell Z is again rotated until the starting position (FIG. 2) is reached, in which the feed core S is arranged at the top seen in the acting direction WK of gravity and the base plate 5 at the bottom. Here the stopper 18 continues to provide a seal for the casting mould F providing security against the melt M running out of the casting mould F.

The casting mould F is held in this position until solidification of the cast part is sufficiently advanced to allow demoulding.

In the exemplary embodiment described here the casting mould F is thus designed in such a way that the feeder S of the casting mould F to be cast is arranged at least to a large extent below the mould cavity H of the mould F, so that the mould cavity H of the casting mould F is initially filled against the force of gravity. Preferably the entire casting mould F is already tilted against the sprue during the filling process in order to reduce the speed of the metal melt M during the first filling and to achieve an even filling process of the pour channel 13 and the feed S. For filling a casting device 18 in the form of a pouring spoon is used which, as explained, during the casting process can follow the rotation of the casting mould F.

Upon completion of the filling process the sprue 13 pointing upwards from the feeder S is sealed and generates metallostatic pressure on the melt M present in the feed S and the mould cavity, which prevents contraction of the melt M.

In the present exemplary embodiment during the subsequent rotation the metal melt M present in the feeder S causes the metallostatic pressure of the metal melt M in the mould cavity to be maintained. Casting defects, such as for example bubbles and cold runs, are thereby excluded.

REFERENCES

1 Device for casting the cast part G
2, 3 Rollers

4 Mounting floor
5 Guide plate
6 Base plate of casting mould F
7, 8 Front slides
9 Pressing plate
10 Feed channel of feed core S
11 Opening of feed core S
12 Ingates
13 Pour channel
14 Filling opening
15 Mouth of the pour channel 13
16 Heating device
17 Casting device
18 Stopper
B Cylindrical sleeves
F Casting mould
G Cast part
H Mould cavity of casting mould F
K Cores
M Metal melt
O Bottom core
S Feed core
SR Main flow direction
T Tracking device
WK Acting direction of gravity
X Axis of rotation
Z Casting cell

The invention claimed is:

1. A method for casting a cast part from a metal melt comprising the following steps:

a) providing a casting mould, mounted in a pivoted mounting, comprising a mould cavity shaping the cast part, a feed system for feeding the mould cavity with metal melt and a pour channel, via which the feed system can be filled with metal melt, wherein the feed system is arranged in relation to the mould cavity of the casting mould so that when the casting mould is rotated into a fill position the filling of the mould cavity with the metal melt takes place via the feed system against the acting direction of gravity, and wherein a filling opening, provided for filling the metal melt, of the pour channel is arranged on a lateral side of the casting mould remotely from a mouth of the pour channel into the feed system so that the filling opening of the pour channel is arranged in the respective fill position of the casting mould above the mouth of the pour channel into the feed system;

b) aligning the casting mould in a fill position in which metal melt filled in the pour channel as a consequence of the effect of gravity flows through the pour channel, wherein the main flow direction of the metal melt makes an angle relative to the acting direction of gravity;

c) filling the casting mould aligned in the fill position with the metal melt, until the casting mould, including the pour channel, is completely filled with metal melt;

d) sealing the casting mould with a stopper placed in the filling opening of the pour channel;

e) rotating the sealed casting mould into a solidification position, in which as a result of the effect of gravity the melt present in the feed system is pushed against the melt present in the mould cavity;

f) holding the casting mould in the solidification position until the metal melt present in the casting mould has reached a certain solidification state;

g) de-moulding of the cast part.

2. The method according to claim 1, wherein the casting mould after reaching a certain fill level of the metal melt is rotated, while continuing to be filled, in such a way that the main flow direction of the metal melt flowing through the pour channel increasingly approximates to the acting direction of gravity.

3. The method according to claim 2, wherein the rotation performed during the filling process is ended when the main flow direction of the metal melt flowing through the pour channel coincides with the acting direction of gravity.

4. The method according to claim 2, wherein rotation of the casting mould is commenced at the earliest when the mouth of the pour channel into the feed system is below the level of the metal melt filled in the casting mould.

5. The method according to claim 2, wherein the metal melt is filled by means of a pouring spoon into the casting mould.

6. The method according to claim 5, wherein the pouring spoon tracks the rotation of the casting mould.

7. The method according to claim 1, wherein at least one section of the casting mould is thermally treated prior to filling of the metal melt.

8. The method according to claim 1, wherein the cast part is an engine block for a combustion engine.

9. The method according to claim 1, wherein an axis of rotation of the casting mould is aligned horizontally.

10. The method according to claim 1, wherein the pour channel of the casting mould runs linearly.

11. The method according to claim 1, wherein the filling opening of the pour channel is allocated to an underside of the casting mould.

* * * * *